United States Patent [19]

Kogan

[11] Patent Number: 4,736,154

[45] Date of Patent: Apr. 5, 1988

[54] VOLTAGE REGULATOR BASED ON PUNCH-THROUGH SENSOR

[75] Inventor: Grigory Kogan, Portland, Oreg.

[73] Assignee: National Semiconductor Corporation, Santa Clara, Calif.

[21] Appl. No.: 92,418

[22] Filed: Sep. 3, 1987

[51] Int. Cl.[4] ..... G05F 3/20

[52] U.S. Cl. ..... 323/313; 363/60

[58] Field of Search ..... 323/311, 312, 313, 314, 323/315, 316; 363/60

[56] References Cited

U.S. PATENT DOCUMENTS 3,806,742 4/1974 Powell ..... 323/313 X 4,670,706 6/1987 Tobita ..... 323/313

FOREIGN PATENT DOCUMENTS 0050413 5/1981 Japan ..... 323/313

*Primary Examiner*—Patrick R. Salce

*Assistant Examiner*—Kristine Peckman

*Attorney, Agent, or Firm*—Limbach, Limbach & Sutton

[57] ABSTRACT

The present invention provides a voltage regulator for generating a controlled voltage for an electrical circuit. The voltage regulator comprises a first field effect transistor (FET) having its drain connected to a first node, its source connected to ground and its gate connected to its source. A resistor is connected between a supply voltage and the first node. A second FET has its source connected to the first node and its drain and gate commonly connected to a second node. A third FET has its drain connected to the supply voltage, its source connected to the second node and its gate connected to the interconnection between the resistor and the drain of the first FET. A fourth FET has its drain connected to the supply voltage, its gate connected to the second node and its source connected to provide an output signal. A fifth FET has its drain connected to the supply voltage, its source connected to the drain of a sixth FET and its gate connected to the first node. A sixth FET has its drain connected to the source of the fifth FET, its source connected to the second node and its gate connected to its drain. A capacitor has one side connected between the source of the fifth FET and the drain of the sixth FET and its other side connected to a resonant oscillator. According to the present invention, the channel length of the first FET corresponds to the minimum channel length of the FETs included in the electrical circuit.

1 Claim, 1 Drawing Sheet

VOLTAGE REGULATOR BASED ON PUNCH-THROUGH SENSOR

BACKGROUND OF THE INVENTION

1. Field of the Invention

The present invention relates to integrated circuits and, in particular, to an integrated, high accuracy voltage regulator.

2. Discussion of the Prior Art

Microminiaturization of MOS field effect transistors (MOSFETs) is a traditional approach in the development of high density dynamic random access memories (DRAMs). However, MOSFETs of submicron geometries may suffer from source/drain punch-through as well as from substrate current. One of the solutions to this problem is reduction of the power supply voltage $V_{CC}$ below 5 V. This reduction in supply voltage conflicts, however, with the desire to be compatible with conventional transistor-transistor-logic (TTL) and other single 5 V power supply designs.

To resolve this conflict, an on-chip voltage regulator has been proposed by Mano et al., "Submicron VLSI Memory Circuits", 1983 IEEE International Solid State Circuit Conference, p. 234. The Mano et al. voltage converter utilizes an external 5 V power supply to feed I/O circuitry containing a relatively small number of transistors, while the main portion of the circuit is fed by a lower voltage from the converter. As shown in FIG. 1, control of the output voltage in the Mano et al. voltage converter circuit is based upon four MOSFETs M1, M2, M3 and M4 which are connected sequentially in diode configuration.

The disadvantage of the Mano et al. voltage converter design is that the source/drain punch-through voltage is tied to the threshold voltages of the four transistors M1–M4. If, for example, the threshold of each transistor varies ±0.2 V, then the output voltage of the converter has an uncertainty factor of ±0.8 V.

SUMMARY OF THE INVENTION

The present invention provides a voltage regulator for generating a controlled voltage for an electrical circuit. The voltage regulator comprises a first field effect transistor (FET) having its drain connected to a first node, its source connected to ground and its gate connected to its source. A resistor is connected between a supply voltage and the first node. A second FET has its source connected to the first node and its drain and gate commonly connected to a second node. A third FET has its drain connected to the supply voltage, its source connected to the second node and its gate connected to the interconnection between the resistor and the drain of the first FET. A fourth FET has its drain connected to the supply voltage, its gate connected to the second node and its drain connected to provide an output signal. A fifth FET has its drain connected to the supply voltage, its source connected to the drain of a sixth FET and its gate connected between the first node and the gate of the third FET. A sixth FET has its drain connected to the source of the fifth FET, its source connected between the second node and the gate of the fourth FET and its gate connected to its drain. A capacitor has one side connected between the source of the fifth FET and the drain of the sixth FET and its other side connected to a resonant oscillator. According to the present invention, the channel length of the first FET corresponds to the minimum channel length of the FETs included in the electrical circuit.

DETAILED DESCRIPTION OF THE INVENTION

Figure 1:
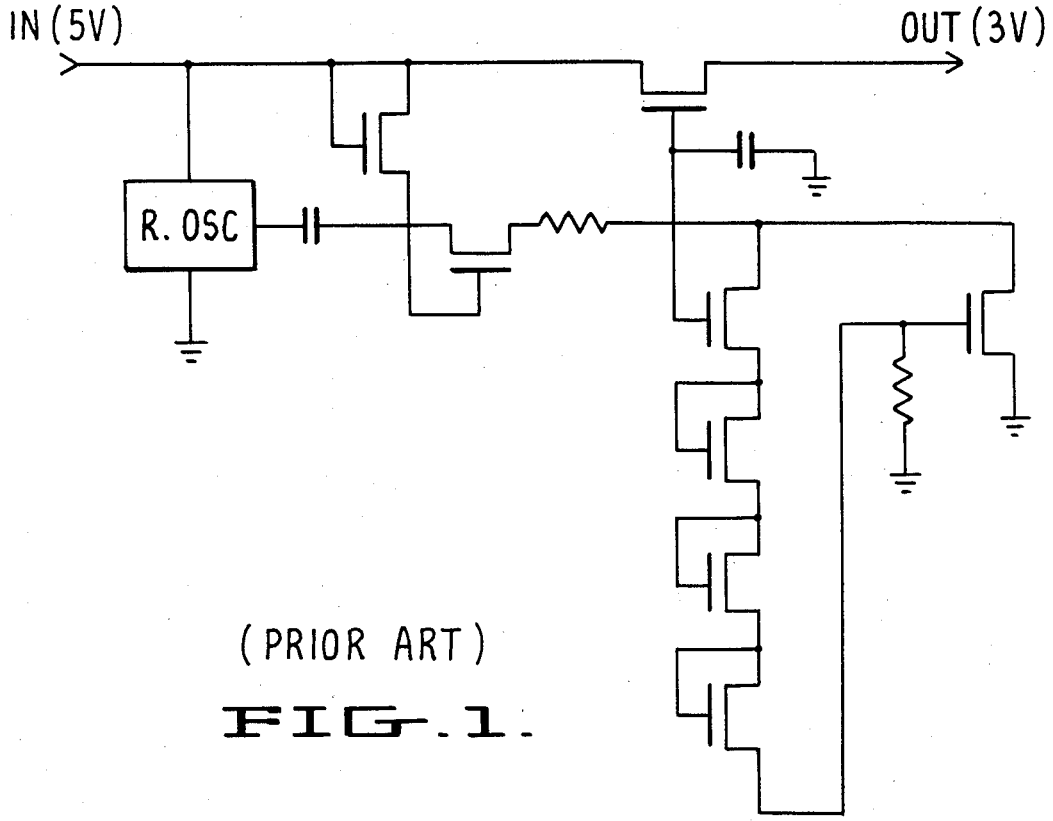
(PRIOR ART) FIG. 1.
FIG. 1 is a schematic drawing illustrating a conventional voltage converter circuit.
Figure 2:
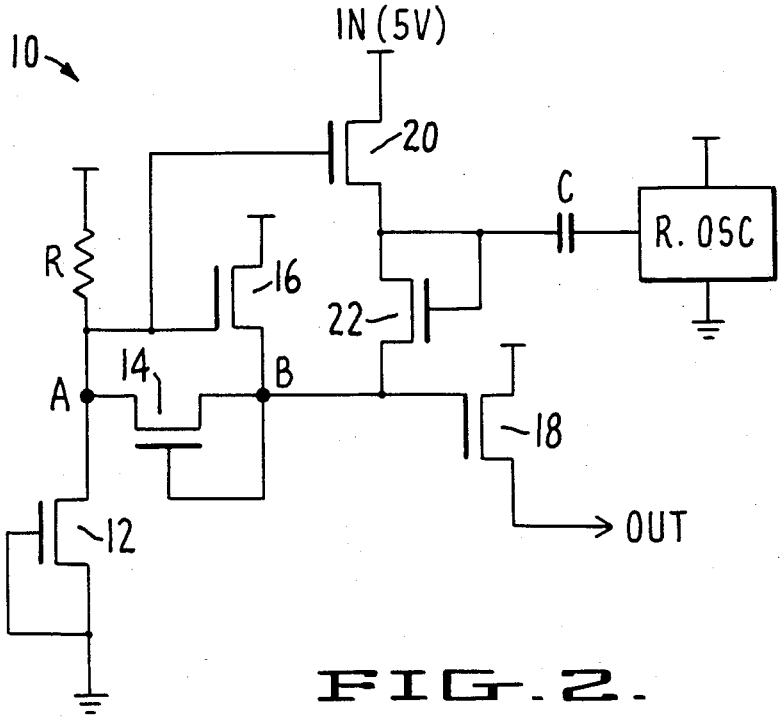
FIG. 2 is a schematic drawing illustrating an embodiment of a voltage regulator circuit in accordance with the present invention.

A voltage regulator 10 based on a punch-through sensor in accordance with the present invention is shown in FIG. 2.

As shown in FIG. 2, the voltage regulator 10 of the present invention consists of a field effect transistor (FET) 12 which has its drain connected to node A, its source connected to ground and its gate connected to its source. A resistor R is connected between the supply voltage $V_{CC}$, typically 5 V, and node A. A second FET transistor 14 is connected between node A and node B such that its source is connected to node A and its drain and gate are commonly connected to node B. A third FET 16 has its drain connected to the $V_{CC}$ supply, its source connected to node B and its gate connected to the interconnection between resistor R and the drain of FET 12. A fourth FET 18 has its drain connected to the $V_{CC}$ supply, its gate connected to node B and its source connected to provide an output signal OUT. Two additional FETs 20 and 22 are connected sequentially between the $V_{CC}$ supply and the interconnection between node B and the gate of FET 18. The drain of FET 20 is connected to the $V_{CC}$ supply, its source is connected to the drain of FET 22 and its gate is connected to node A. The drain of FET 22 is connected to the source of FET 20, while its source is connected to node B. The gate of FET 22 is connected to its drain. A capacitor C has one of its sides connected to the interconnection between the source of FET 20 and the drain of FET 22 and its other side connected to a resonant oscillator.

Resistor R and FET 12 form a drain/source punch-through sensor. The channel length of FET 12 corresponds to the on-chip minimum. Consequently, maximum voltage at node A is equal to the punch-through voltage of the on-chip minimal geometry transistor. FET 14, which is in diode configuration, maintains the gate of FET 18 at a voltage level $V_B = V_A + V_T$ (where $V_T$ is the threshold voltage of FET 14) which corresponds to $V_{OUT} \leqq V_A$. FET 16 precharges node B during power up. FETs 20 and 22, together with capacitor C, form a charge pump to sustain the voltage at node B.

Thus, the voltage regulator of the present invention provide self-correlation such that the output voltage of the regulator is equal to the drain/source breakdown voltage of device 12 or the $V_{CC}$ supply, whichever is less.

It should be understood that various alternatives to the embodiment of the invention described herein may be employed in practicing the invention. It is intended that the following claims define the scope of the invention and that the structure within the scope of these claims and their equivalents be covered thereby.

What is claimed is:

1. A voltage regulator for providing a controlled voltage to an electrical circuit, comprising:

(a) a first field effect transistor (FET) having its drain connected to a first node, its source connected to ground and its gate connected to its source;

(b) a resistor connected between a supply voltage and the first node;

(c) a second FET having its source connected to the first node and its drain and gate commonly connected to a second node;

(d) a third FET having its drain connected to the supply voltage, its source connected to the second node and its gate connected to the interconnection between the resistor and the drain of the first FET;

(e) a fourth FET having its drain connected to the supply voltage, its gate connected to the second node and its source connected to provide an output signal;

(f) a fifth FET having its drain connected to the supply voltage, its source connected to the drain of a sixth FET and its gate connected to the first node;

(g) a sixth FET having its drain connected to the source of the fifth FET, its source connected to the second node and its gate connected to its drain; and (h) a capacitor having one side connected between the source of the fifth FET and the drain of the sixth FET and its other side connected to a resonant oscillator wherein the channel length of the first FET corresponds to the minimum channel length of the FETs included in the electrical circuit.

* * * * *